US007811072B2

(12) United States Patent
Mitchell

(10) Patent No.: US 7,811,072 B2
(45) Date of Patent: Oct. 12, 2010

(54) GEAR PUMP

(75) Inventor: David Mitchell, Carina Heights (AU)

(73) Assignee: Private Brand Tool (Australia) Pty Ltd., Heathwood, Queensland (AU)

( * ) Notice: Subject to any disclaimer, the term of this patent is extended or adjusted under 35 U.S.C. 154(b) by 660 days.

(21) Appl. No.: 11/822,789

(22) Filed: Jul. 10, 2007

(65) Prior Publication Data

US 2009/0016919 A1 Jan. 15, 2009

(51) Int. Cl.
*F01C 1/18* (2006.01)

(52) U.S. Cl. ..... 418/205

(58) Field of Classification Search ..... 418/205
See application file for complete search history.

(56) References Cited

U.S. PATENT DOCUMENTS 2,023,250 A * 12/1935 Stalder ..... 92/138
2,472,031 A * 5/1949 Wichorek ..... 418/77
2,651,545 A * 9/1953 Shotton ..... 418/181
2,833,224 A 5/1958 Meyer et al.
2,966,860 A 1/1961 Maynard
3,746,262 A * 7/1973 Bete et al. ..... 239/458
5,191,666 A * 3/1993 Corbin ..... 7/158
5,715,869 A * 2/1998 Patterson ..... 138/35
6,171,089 B1 * 1/2001 Oehman, Jr. ..... 418/75
6,321,855 B1 * 11/2001 Barnes ..... 173/211
6,325,604 B1 12/2001 Du
6,547,542 B1 * 4/2003 Komer ..... 418/1
6,663,368 B2 12/2003 Saiz
2005/0106055 A1 * 5/2005 Lipscombe ..... 418/206.1
2005/0232789 A1 * 10/2005 Hinz et al. ..... 417/410.1

OTHER PUBLICATIONS

Self-Priming Drill Pump Kit, retrieved online http://www.amazon.com on Jan. 2, 2007.
Axminster Drill Pump, Axminster Power Tool Center, retrieved online http://www.axminster.co.uk on Jan. 2, 2007.
Drill Pumps, Aubuchon Hardware, retrieved online http://plumbing.hardwarestore.com on Jan. 2, 2007.
Simer Drill Pump, retrieved online at http://www.shopping.com on Jan. 2, 2007.
Vitrex Drill Pump #401881, Just Tools, retrieved online http://www.justtools.com.au on Jan. 2, 2007.

* cited by examiner

*Primary Examiner*—Thomas E Denion
*Assistant Examiner*—Mary A Davis
(74) *Attorney, Agent, or Firm*—Nixon & Vanderhye P.C.

(57) ABSTRACT

A gear pump (1) for use with a hand-operated tool (200) having a rotatable shaft (201), said gear pump (1) comprising: a housing (5) having a chamber (6), an inlet (65) for fluid into the chamber (6) and an outlet (66) for fluid from the chamber (6); and a gear assembly (2) comprising at least one gear (21) mounted for rotation within the chamber (6) between the inlet (65) and outlet (66), and a drive shaft (24, 25) extending from the gear (21) and externally of the chamber (6), wherein a tool-engaging end (25) of the drive shaft (24, 25) is engageable with the rotatable shaft (201) of the hand tool (200) such that rotation of the drive shaft (24, 25) by the hand tool (200) causes fluid to move between said inlet (65) and outlet (66).

14 Claims, 11 Drawing Sheets

GEAR PUMP

FIELD OF THE INVENTION

This invention relates to a gear pump for use with a hand-operated tool having a rotatable shaft. In particular, the invention concerns a gear pump for use with an air-operated ratchet, cordless drill or crank handle.

BACKGROUND OF THE INVENTION

Hand-operated tools such as air ratchets, cordless drills and hand-operated crank handles are used on a daily basis to remove and install fasteners. Technicians repairing and maintaining vehicles predominantly use air ratchets. Carpenters and builders, on the other hand, tend to use cordless drills.

Sometimes it is necessary to transfer fluids, such as oil, coolant, water and general spillage, from one location to another. Usually this is done using a stand-alone pump of sorts. It would be beneficial to have a pump attachment for an existing hand-operated tool, for driving the pump. The present inventor has now developed such a pump attachment for a hand-operated tool.

SUMMARY OF THE INVENTION

According to the present invention, there is provided a gear pump for use with a hand-operated tool having a rotatable shaft, said gear pump comprising:

- a housing having a chamber, an inlet for fluid into the chamber and an outlet for fluid from the chamber; and
- a gear assembly comprising at least one gear mounted for rotation within the chamber between the inlet and outlet, and a drive shaft extending from the at least one gear and externally of the chamber, wherein a tool-engaging end of the drive shaft is engageable with the rotatable shaft of the hand tool such that rotation of the drive shaft by the hand tool causes fluid to move between said inlet and outlet.

The housing may be of any suitable size, shape and construction, and may be made of any suitable material or materials. Likewise, the chamber may be of any suitable shape and volume. The housing may have a top wall, a bottom wall and at least one side wall extending around the chamber between the top and bottom walls.

The housing may comprise two or more connectable pieces so as to provide ready access to components within the housing. Preferably, the housing comprises a lid portion that is detachable from a base portion, and the base portion contains the gear. The lid and base portions may be detachably connected to one another in any suitable way, e.g. by way of fasteners. The housing may comprise a seal located between the lid and base portions, for rendering the connection fluid-tight.

Any suitable type of gear assembly may be used. The gear assembly may have any suitable number of gears. If the gear assembly comprises a single gear, then the chamber may be substantially circular when viewed in plan. If the gear assembly comprises two intermeshed gears, then the chamber may be substantially oval (i.e. a completely rounded rectangle) when viewed in plan, and fluid may be moved between teeth of the gears and the adjacent housing side wall. Preferably, the gear assembly includes a second idler gear having teeth intermeshed with the teeth of the at least one (drive) gear.

The inlet and outlets for fluid may be at any suitable location. Preferably, the inlet and outlet are diametrically opposed to one another. If the chamber is a completely rounded rectangle, then preferably the inlet and outlet are located at opposing longitudinal sides of the rectangle. The inlet and outlet may be provided by respective tubes extending from the housing side wall. The end of each tube may be threaded for connection to a hose or hose fitting.

The gear may be mounted for rotation within the chamber in any suitable way. Preferably, the drive shaft extends from a central axis of the gear, from each face of the gear, and the gear rotates about this axis.

The housing may comprise one or more bearings in which one or more ends of the drive shaft extend. A bottom bearing may extend downwardly from the bottom wall/base portion of the housing and a top bearing may extend upwardly from the top wall/lid portion of the housing, such that opposing ends of the drive shaft locate and rotate within those bearings. The top bearing may be open-ended and the drive shaft may extend sealingly there through. Preferably, an O-ring extends around the drive shaft and is sandwiched between an upper face of the gear and a shoulder of the top bearing. That is, the top bearing may have a stepped diameter. Preferably, there is a clearance between the top bearing and the tool-engaging end of the drive shaft, so as to accommodate any eccentricity in the rotation of the shaft of the tool.

The drive shaft may be of unitary construction or may comprise two or more detachably connected pieces. The tool-engaging end of the drive shaft may be engageable with the rotatable shaft of the hand-operated tool in any suitable way. Preferably, the tool-engaging end of the drive shaft is detachably connected to a remainder of the drive shaft and may be interchanged with other types of tool-engaging ends, for connection to different types of rotatable tool shafts. Preferably, the remainder of the drive shaft has a socket for receiving a suitably shaped end of the tool-engaging end, whereby the remainder of the drive shaft and tool-engaging end are shaped such that they must rotate in unison. Preferably, the socket is square-shaped and receives a likewise shaped end of the tool-engaging end.

Preferably, the tool-engaging end has a socket for receiving an end of the rotatable shaft of the tool, whereby the tool-engaging end and rotatable shaft are shaped such that they must rotate in unison. Preferably, the socket is square-shaped and receives a likewise shaped end of the rotatable shaft. The end of the rotatable shaft may in fact correspond to a drive adapter (bit) that is detachably connected to the shaft of the tool.

The tool-engaging end and rotatable shaft may lock together such that they do not disengage by accident during operation, and this may be achieved in any suitable way. The tool-engaging end and rotatable shaft (or the mentioned drive adaptor) may have respective female and male portions that engage one another. Preferably, the rotatable shaft has detents locatable within recesses of the socket, although the detents and recesses could be swapped around. Such detents are preferably hemi-spherical and locate within hemi-spherical recesses/openings. Alternatively or additionally, the drive shaft and rotatable shaft may be magnetised such that they lock together.

The gear pump may have means for keeping the chamber primed with fluid and this may be achieved in any suitable way. Preferably, the gear pump comprises a shut-off valve associated with the inlet and a shut-off valve associated with the outlet. A suitable shut-off valve comprises a ball locatable on a valve seat. Preferably, the gear pump comprises a hose fitting having an internal shut-off valve, and having a threaded end connectable to the inlet or outlet tube and an opposing end connectable to a hose of the gear pump. Preferably, the hose fitting is of the type to allow for quick coupling of the hose and to close the shut-off valve when the hose is not connected.

The gear pump may comprise an inlet hose having a male end connectable to the hose fitting that is connected to the inlet tube and an outlet hose having a male end connectable to the hose fitting that is attached to the outlet tube.

The gear pump may comprise a holding member extending from the housing for further holding a body of the hand-operated tool relative to the housing after the output shaft has engaged the drive shaft. This may be desirable such that: the output shaft cannot disengage the drive shaft by accident; the body cannot revolve through a complete revolution relative to the housing; and/or, the gear pump may be held and operated using only one hand. The holding member may be of any suitable size, shape and construction, and may be made of any suitable material or materials. Preferably the holding member is a bracket.

The presence and shape of the holding member will depend on the nature of the hand-operated tool. The tool may be, for example, an air-operated ratchet, a cordless drill or a manually operated crank handle. If the tool is a crank handle, then the gear pump need not have a bracket.

In one embodiment, during operation, the holding member engages the body of the air ratchet or cordless drill and prevents the tool body from revolving through a complete revolution relative to the housing. In a preferred embodiment, the holding member engages and hooks around the body of the tool relative to the housing after the body has rotated through an arc relative to the output shaft, upon activation of the tool.

If the tool is an air ratchet having a cylindrical body, then the bracket may be arcuate and extend from the housing and hook around a top of the body. The bracket may have various radii so as to facilitate proper engagement with tool bodies of varying diameter.

If the tool is a cordless drill having a cylindrical body, then the bracket may extend from the housing alongside the body of the drill. The bracket may further hook around a top of the body.

Preferred embodiments of the invention will now be described by way of example with reference to the accompanying drawings.

DESCRIPTION OF THE PREFERRED EMBODIMENTS

Figure 1:
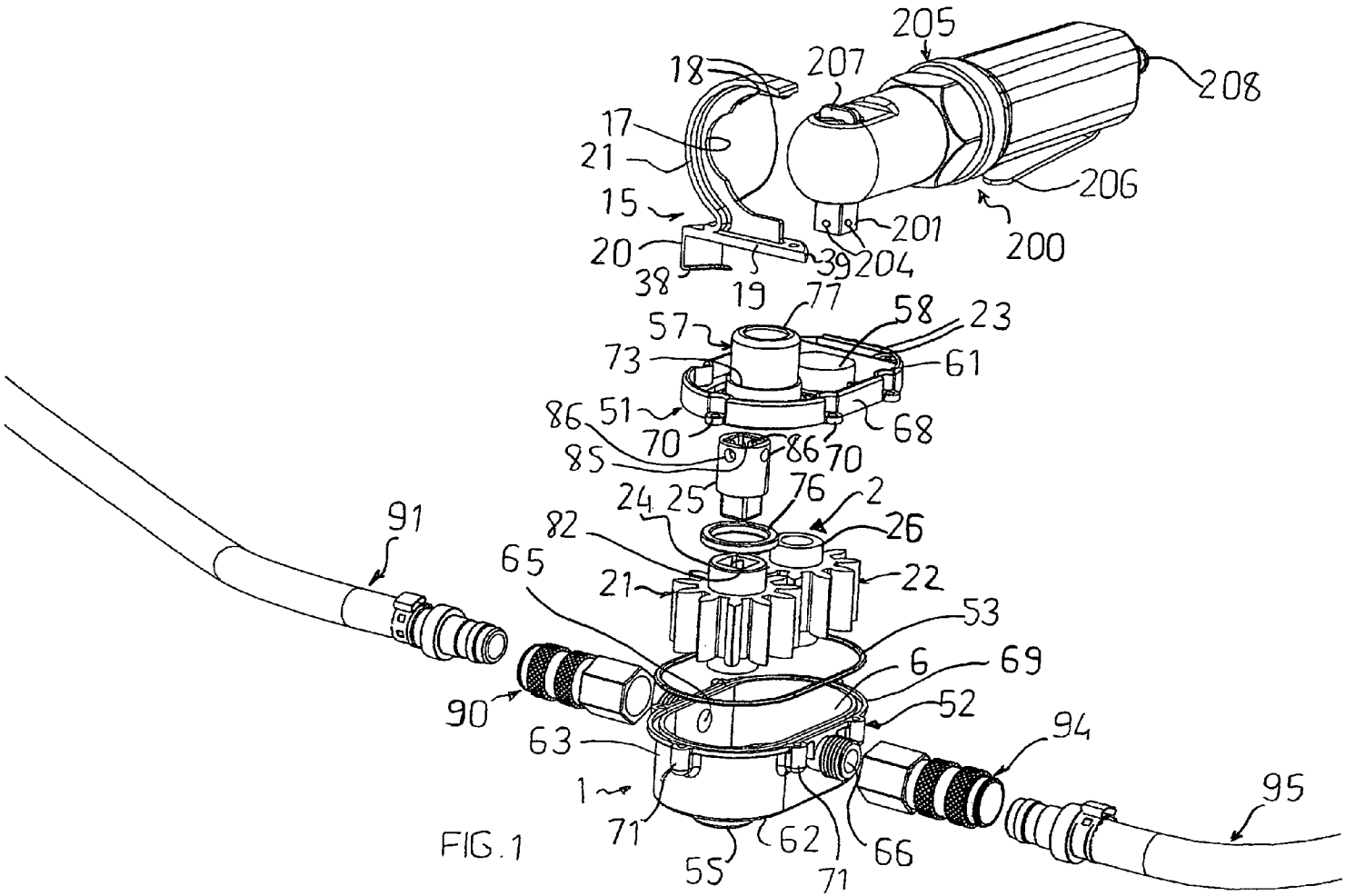
FIG. 1 is an exploded perspective view of a gear pump according to an embodiment of the present invention and an air ratchet.
Figure 2:
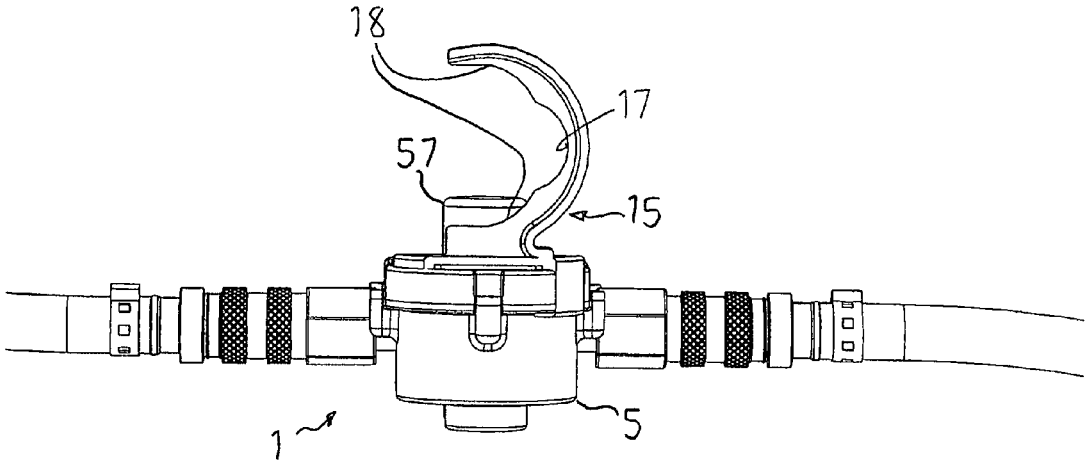
FIG. 2 is an end elevation view of the gear pump shown in FIG. 1.

In the figures like reference numerals refer to like features.

The figures show a gear pump 1 for use with a hand-operated tool having a rotatable output shaft, such as an air ratchet 200, cordless drill 300 or crank handle 400.

Referring now to FIGS. 1 to 8, the gear pump 1 includes a housing 5 having a chamber 6 (see FIG. 1), a gear assembly 2 and a removable holding member 15, 16*a*, 16*b* for holding the tool 200, 300 relative to the housing 5.

The gear assembly 2 includes a drive gear 21 and an idler gear 22 mounted for rotation within the chamber 6. The gears 21, 22 are intermeshed and the chamber 6 is substantially oval (i.e. a completely rounded rectangle) when viewed in plan. The chamber 6 has an inlet 65 for fluid and an outlet 66 for fluid. The inlet 65 and outlet 66 are provided by respective threaded tubes 65, 66 extending from the side wall 63 at opposing longitudinal sides of the chamber 6.

The gear assembly 2 includes a drive shaft 24, 25, 26 extending vertically from each gear 21, 22. Each drive shaft 24, 25, 26 extends from a central axis of the gear 21, 22, from each face of the gear 21, 22, and the gear 21, 22 rotates about this axis.

As seen in FIG. 1, the housing 5 has a top wall 61, a bottom wall 62 and a side wall 63 extending around the chamber 6. The housing 5 has a lid portion 51 that is detachable from a base portion 52. A rim 68 extends along a periphery of the top wall 61 and a rim 69 extends along a periphery of the bottom wall 62. An annular gasket 53 located between the rims 68, 69 renders the connection between the portions 51, 52 fluid-tight. The portions 51, 52 are connected together by way of screws that locate within two-part screw housings 70, 71 that extend laterally of the rims 68, 69.

Figure 3:
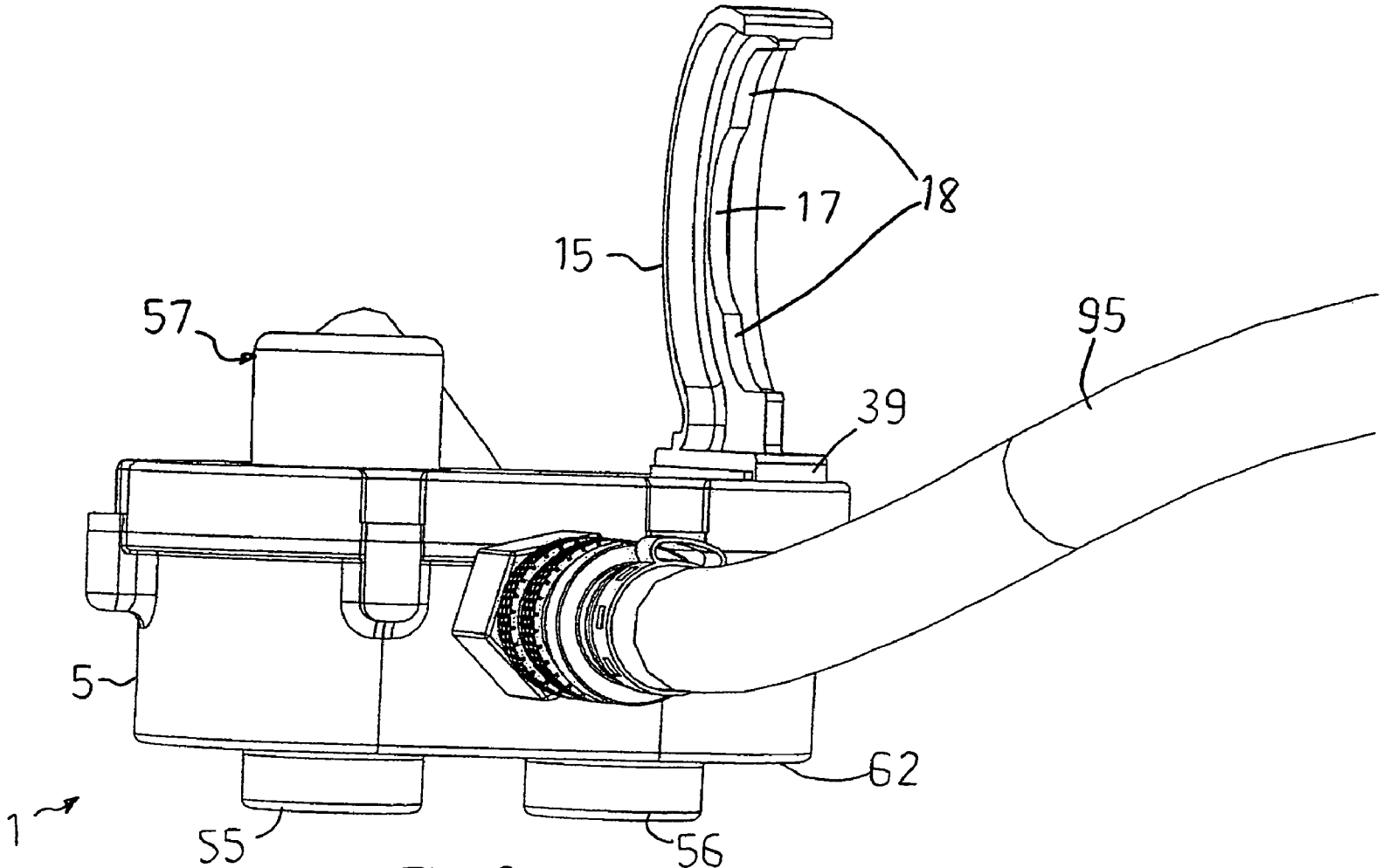
FIG. 3 is a side elevation view of the gear pump shown in FIG. 1.
Figure 4:
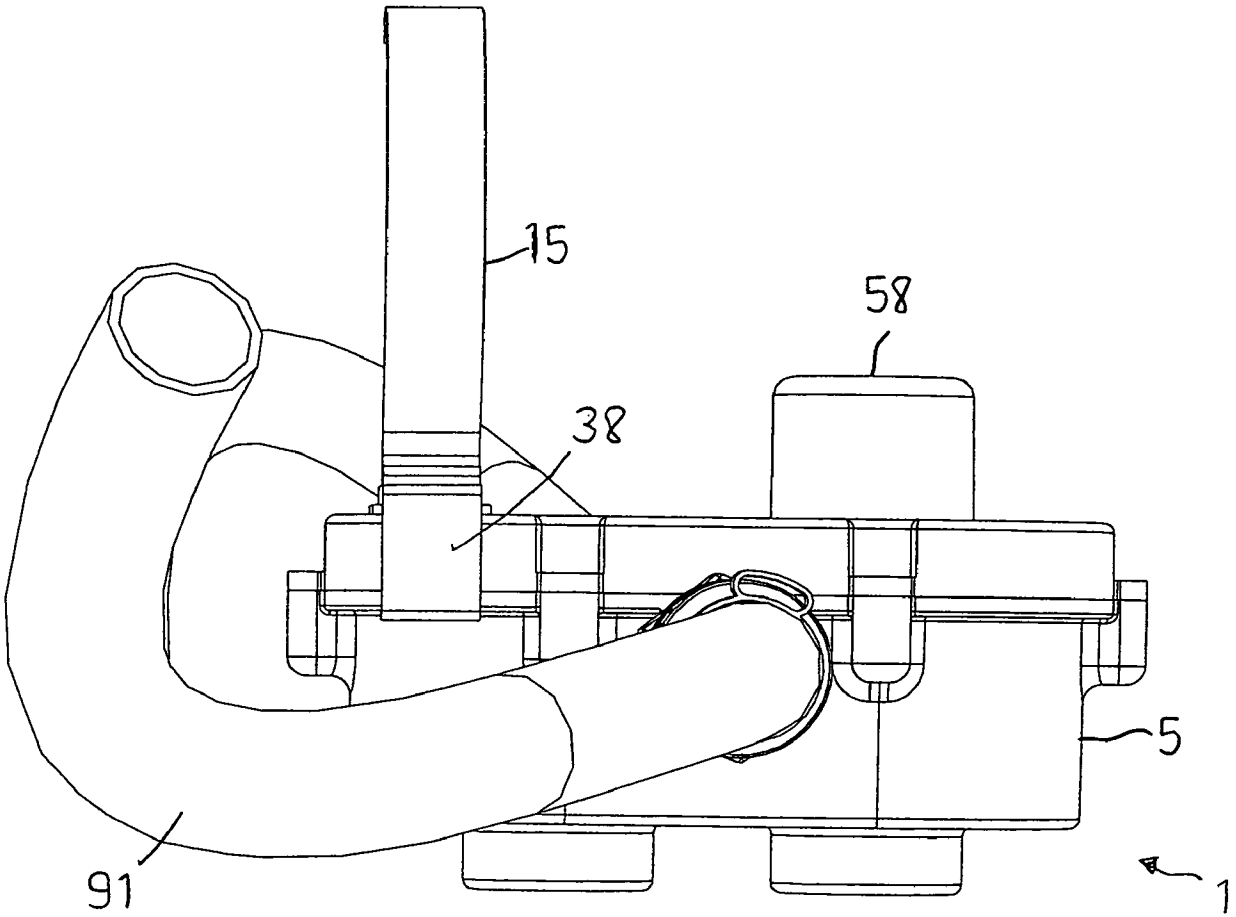
FIG. 4 is another side elevation view of the gear pump shown in FIG. 1.
Figure 5:
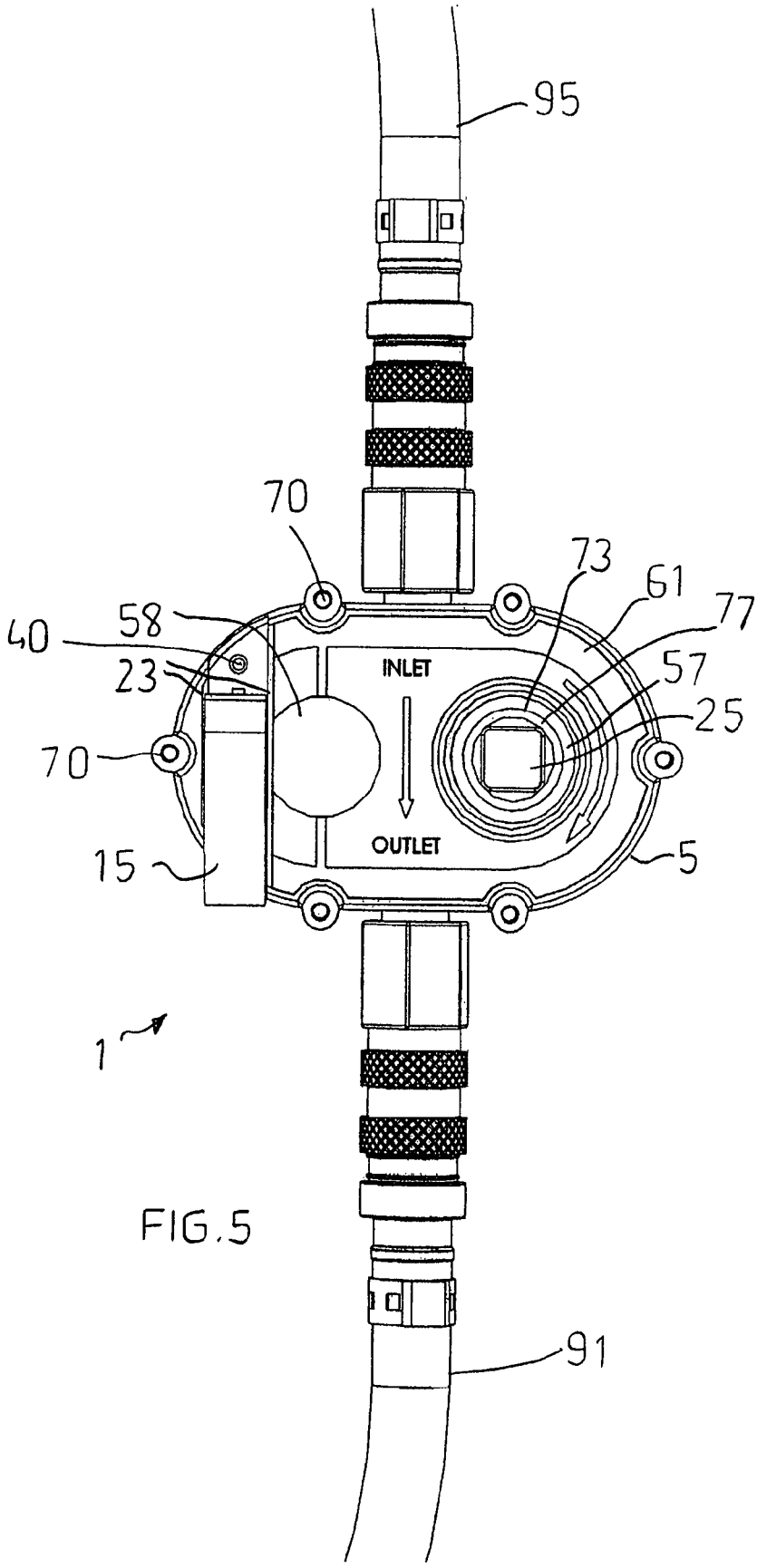
FIG. 5 is a top plan view of the gear pump shown in FIG. 1.
Figure 6:
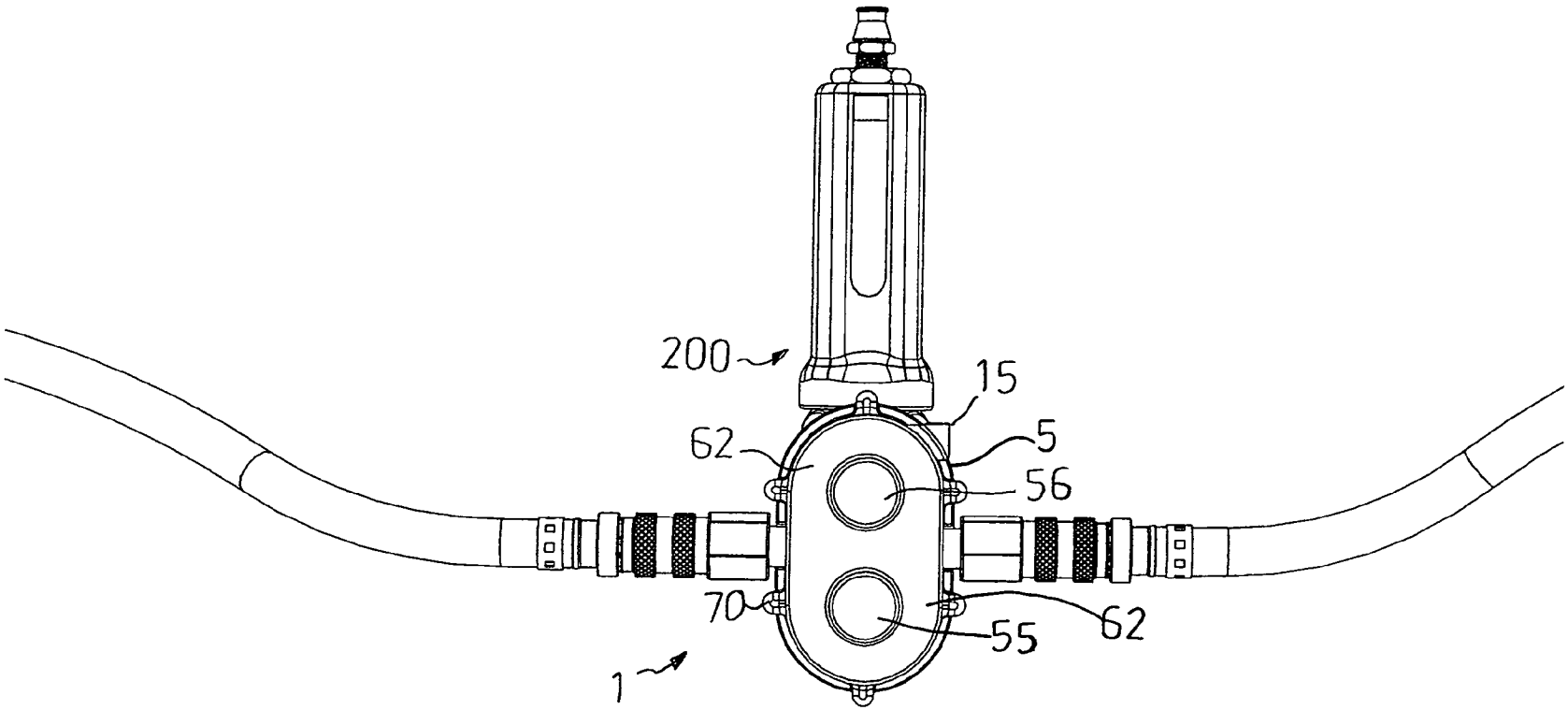
FIG. 6 is a bottom plan view of the gear pump shown in FIG. 1 when connected to an air ratchet.
Figure 7:
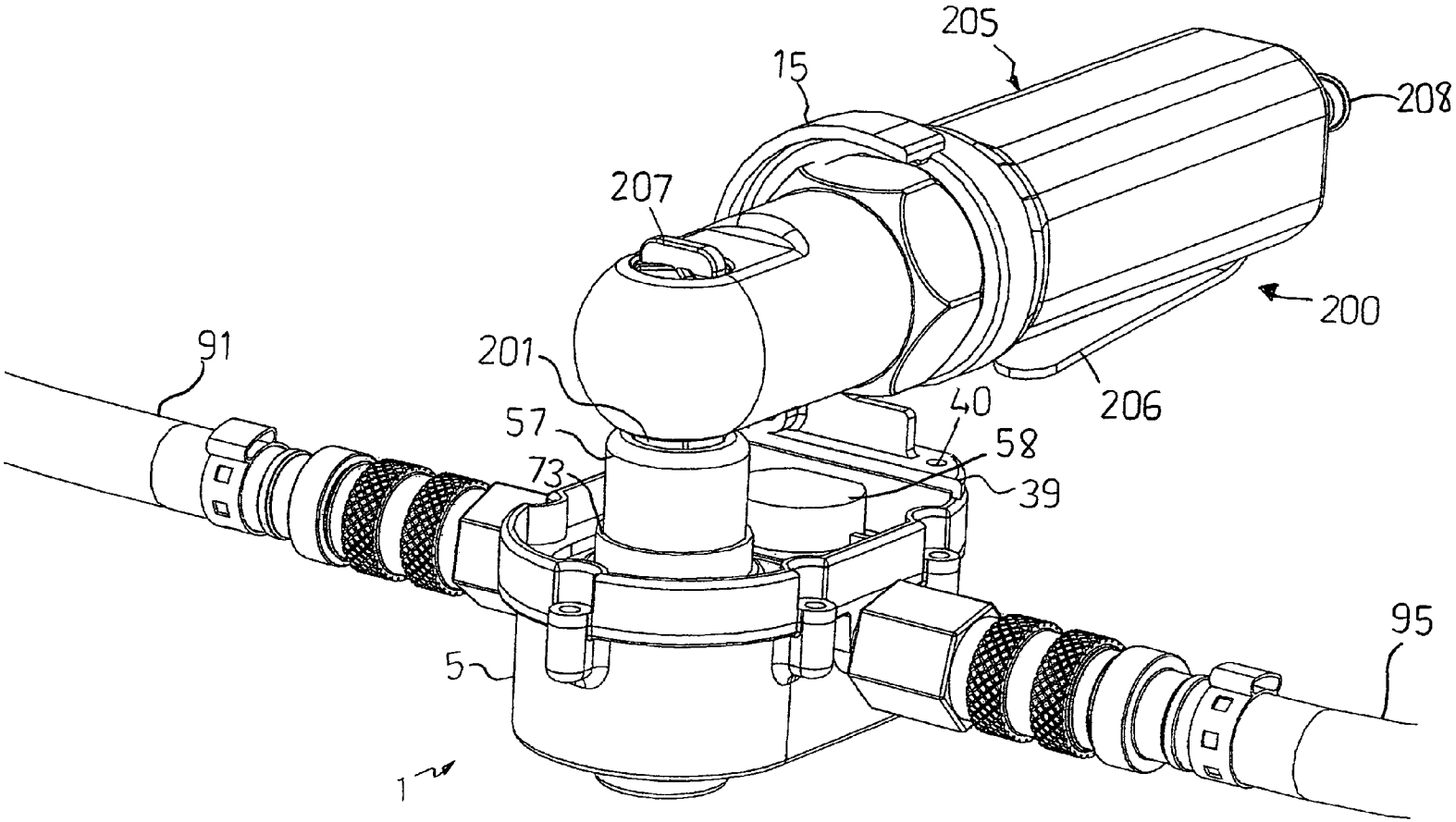
FIG. 7 is a perspective view of the gear pump shown in FIG. 1 when connected to an air ratchet.
Figure 8:
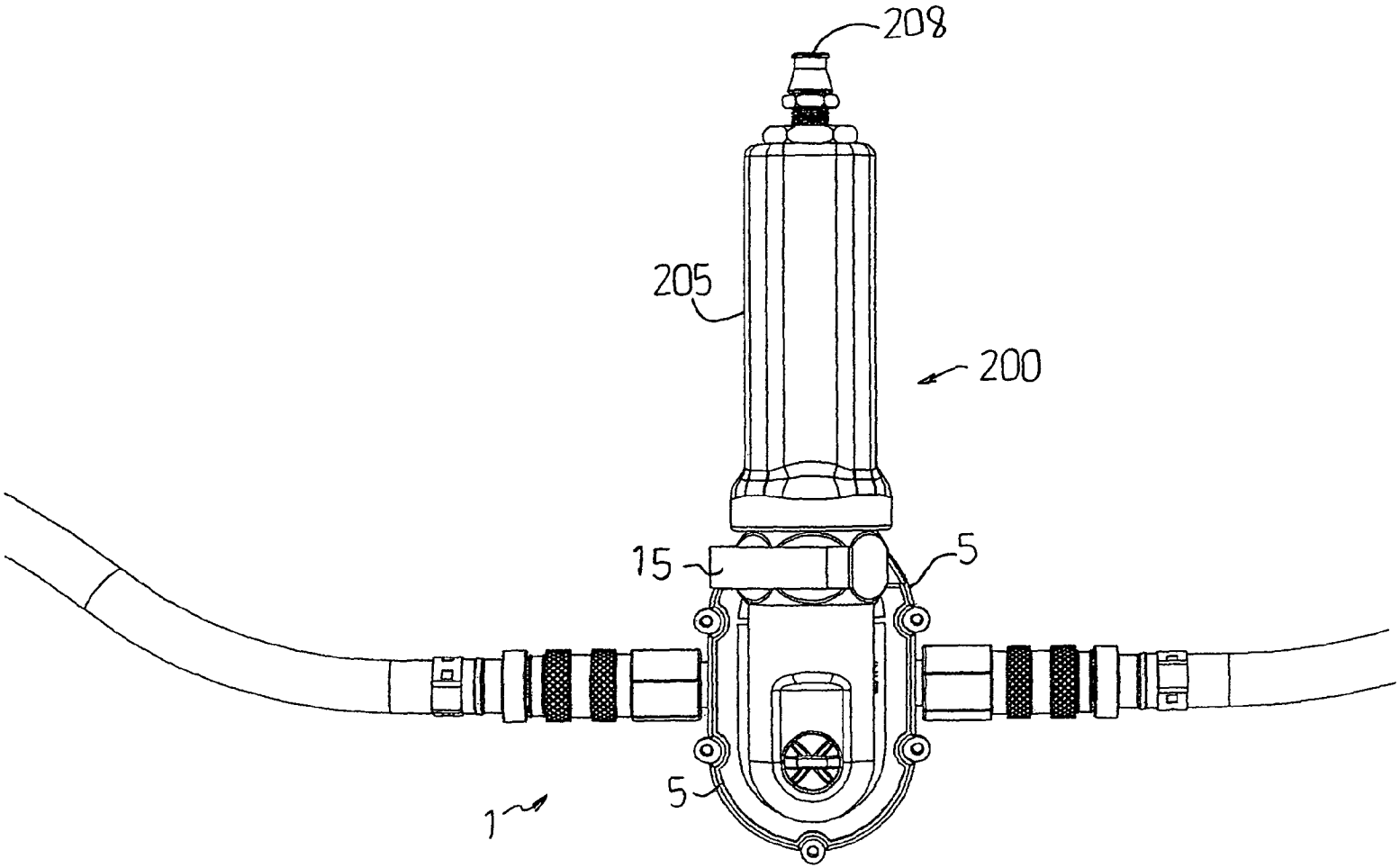
FIG. 8 is a top plan view of the gear pump shown in FIG. 1 when connected to an air ratchet.

A pair of bottom bearings 55, 56 having blind bores extends downwardly from the bottom wall 62, as seen in FIGS. 3 and 6. A pair of top bearings 57, 58 extends upwardly from the top wall 61, as seen in FIGS. 1 and 5. Top bearing 58 has a blind bore whereas top bearing 57 is open-ended. The opposing ends of drive shaft 24, 25 of gear 21 locate and rotate within bearings 57 and 55. The opposing ends of drive shaft 26 of gear 22 locate and rotate within bearings 58 and 56.

Top bearing 57 has a stepped diameter that provides a shoulder 73. An O-ring 76 extends around the drive shaft 24 and is sandwiched between an upper face of the gear 21 and the shoulder 73. In this way, the drive shaft 24, 25 extends sealingly through the top bearing 57, such that there is no leakage of fluid from the chamber 6.

The drive shaft 24, 25 of drive gear 21 comprises detachably connected pieces 24 and 25. A tool-engaging end piece 25 of the drive shaft 24, 25 is engageable with the rotatable shaft 201, 301, 401 of the tool 200, 300, 400. The tool-engaging end piece 24 may be interchanged with other types of tool-engaging ends, for connection to different types of rotatable tool shafts. Drive shaft piece 24 has a square-shaped socket 82 for receiving a lower end of the tool-engaging end piece 25, such that the pieces 24, 25 must rotate in unison.

The tool-engaging end piece 25 has a square-shaped socket 85 for receiving a square-shaped end of the rotatable shaft 201, 301, 401 of the tool 200, 300, 400. The tool-engaging end piece 25 and rotatable shaft 201, 301, 401 lock together such that they can not disengage by accident during operation. To this end, the tool-engaging end piece 25 has four openings 86 and rotatable shaft 201, 301, 401 has hemi-spherical projections (detents) 204, 304, 404 that lock within the openings 86. Alternatively or additionally, the drive shaft 24, 25 and rotatable shaft 201, 301, 401 may be magnetised such that they lock together.

An inwardly extending rim 77 at an upper end of the top bearing 57 ensures that tool-engaging end piece 25 will remain within the bearing 57. There is a clearance between the top bearing 57 and the tool-engaging end piece 25 so as to accommodate any eccentricity in the rotation of the output shaft 201, 301, 401 of the tool.

The gear pump 1 includes a pair of hose fittings 90, 94, an inlet hose 91 and an outlet hose 95. The gear pump 1 also has a shut-off valve (not shown) associated with the inlet 65 and a shut-off valve (not shown) associated with the outlet 66, for keeping the chamber 6 primed with fluid and for reducing fluid spillage during storage. The first hose fitting 90 has an internal shut-off valve, a threaded end connectable to the inlet tube 65 and an opposing end connectable to inlet hose 91. The second hose fitting 94 has an internal shut-off valve, a threaded end connectable to the outlet tube 66 and an opposing end connectable to outlet hose 95. The fittings 90, 94 are of the type to allow for quick coupling of the hoses 91, 95 and to close the shut-off valves when the hoses 91, 95 are not connected.

As seen in FIGS. 1 to 10, the gear pump 1 may have a holding member/bracket 15, 16*a*, 16*b* extending from the housing 5 for further holding the body 205, 305 of the tool relative to the housing 5 after the output shaft 201, 301 has engaged the drive shaft 24, 25. This may be desirable such that: the output shaft 201, 301 cannot disengage the drive shaft 24, 25 by accident; the body 205, 305 cannot revolve through complete revolutions relative to the housing 5; and, the gear pump 1 may be held and operated using only one hand.

Figure 11:
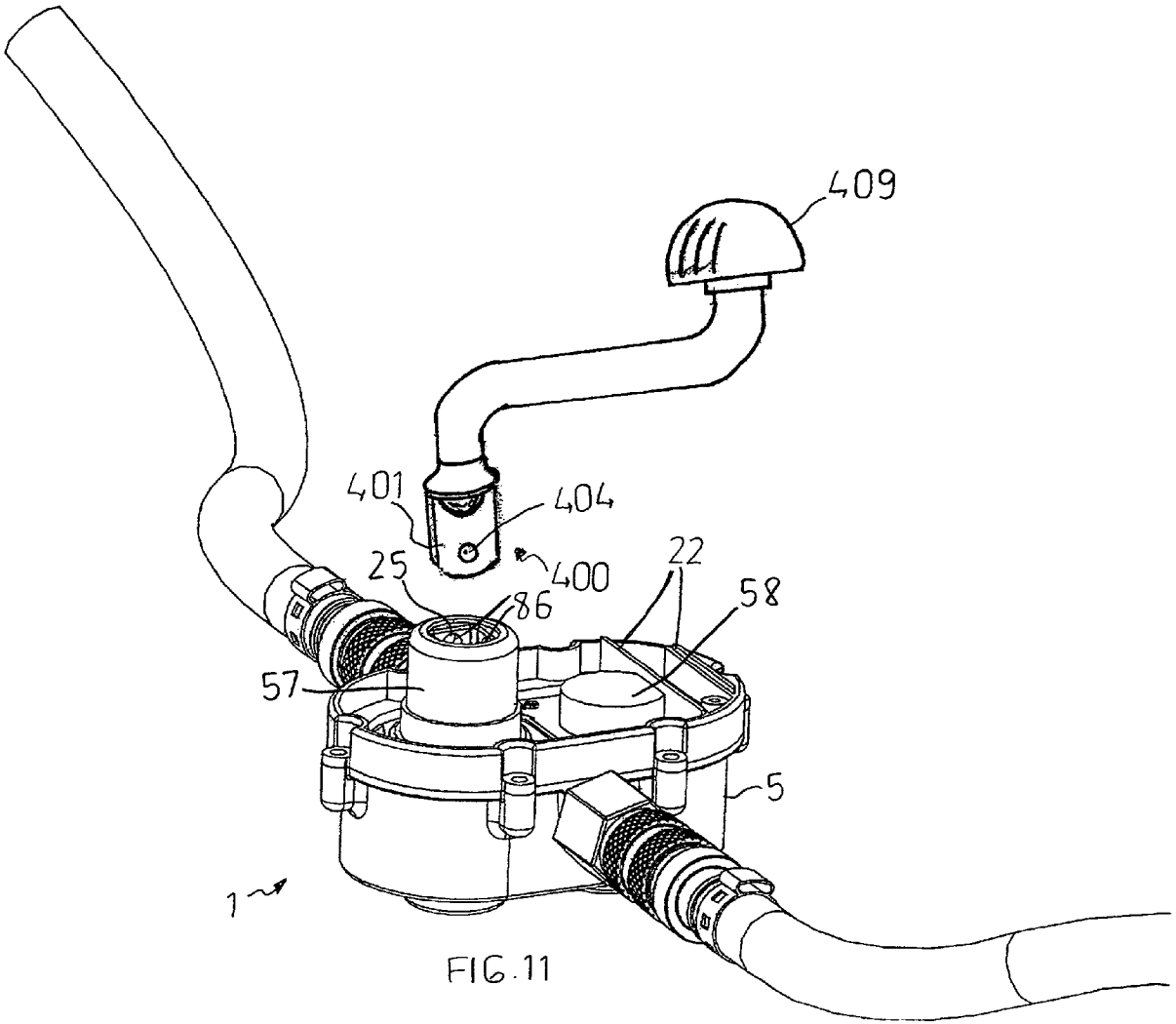
FIG. 11 is a side perspective view of the gear pump shown in FIG. 1 but lacking a bracket, and the gear pump is being connected to a crank handle.

The presence and shape of the holding member/bracket will depend on the nature of the hand-operated tool. If the tool is a crank handle 400, as seen in FIG. 11, then the gear pump 1 need not have a bracket.

The gear pump 1 can be used to either remove waist fluids or replenish new fluids (e.g. water, coolant or oil). It is operated by placing the inlet hose 91 into a fluid source to be evacuated and the outlet hose 95 into a waste fluid source or into a receptacle to be filled. The tool 200, 300, 400 is attached to the gear pump 1 and rotated. The rotating action of the two gears 21, 22 creates a low pressure at the inlet 65 and a higher pressure at the outlet 66. The low pressure draws fluid into the chamber 6. The rotating gears 21, 22 then capture a volume of fluid in the void between each gear tooth segment and the housing 6. This fluid is dispelled via the outlet 66 as the gear 21, 22 teeth come into mesh at a central region of the chamber 6. This action creates fluid flow from the inlet 65 to the outlet 66.

As seen in FIGS. 1 and 6 to 8, the gear pump 1 may be used with an air ratchet 200 having a body 205, an on/off switch 206, an inlet for compressed air 208, a standard ⅜" rotatable output shaft 201, and a switch 207 for setting the direction of rotation of the shaft 201. The bracket 15 is arcuate, it extends from the housing 5 and hooks around a top of the body 205. The bracket 15 has a base portion 20 and an upstanding arcuate portion 21. The upstanding arcuate portion 21 has an inner face and an outer face. The inner face of the upstanding arcuate portion 21 has various (multi-stepped) radii 17, 18. The base portion 19 extends between a pair of rails 22 of the top wall 61. One end 38 of the base portion 19 hooks around and beneath rim 69 of the housing 5. The other end 39 of the base portion 19 is fastened to the top wall 61 with a screw 40.

In use, the rotatable shaft 201 of the air ratchet 200 is brought into engagement with the tool-engaging end piece 25 such that the hemi-spherical projections 204 lock within the openings 86. The switch 207 for setting the direction of rotation of the shaft 201 is set such that fluid will be pumped from the inlet 65 to the outlet 66. Upon depressing the on/off switch 206, the body 205 initially rotates into engagement with the inner face of the arcuate portion 21 of the bracket 15 such that the pump 1 can be operated using a single hand without fear of disengagement of the pump 1 from the ratchet 200.

In order to pump fluid from the outlet 66 to the inlet 65, the switch 207 is set accordingly, the switch 206 is depressed and the body 205 initially rotates into engagement with the outer face of the upstanding arcuate portion 21.

Almost all technicians now use air ratchets to remove and install fasteners on a daily basis for vehicle repair and maintenance, so to have available an add-on gear pump 1 attachment for their existing ratchet would be beneficial. As an attachment for an existing product, it provides a low cost means for carrying out any type of fluid transfer.

Air ratchets come in a range of shapes and sizes, so a challenge faced in the design of the present gear pump 1 was to create a bracket that would both suit the range of sizes and also still be quick to attach. The current bracket 15 design allows an operator to lockingly engage the drive 201 of the ratchet 200 into the tool-engaging end piece 25 of the pump 1, then the natural rotation caused by operating the air ratchet 200 brings the body 205 of the ratchet 200 into engagement with the bracket 15. The bracket 15 has staged radii 17, 18 to accommodate a range of ratchet body 205 diameters.

Figure 9:
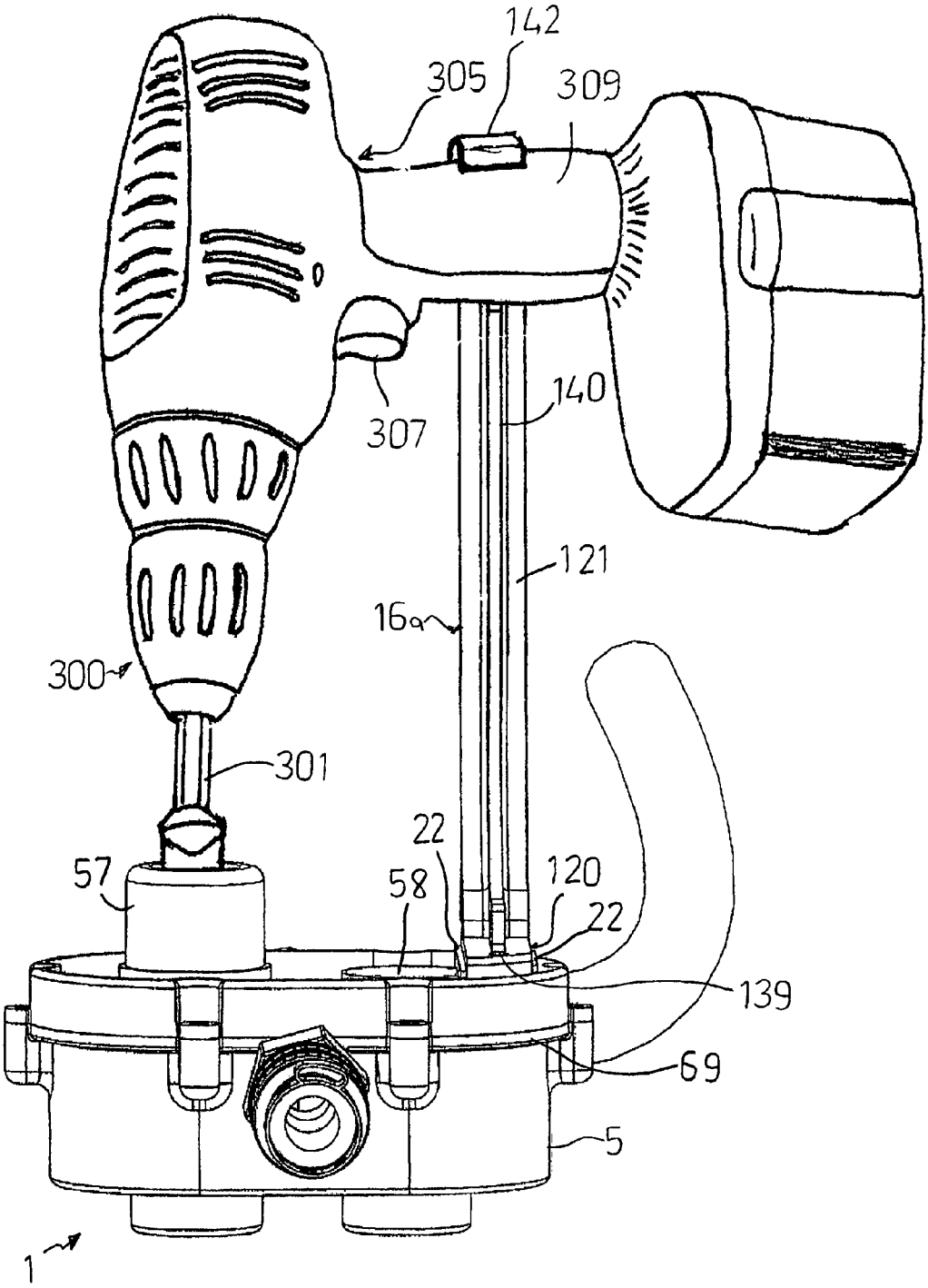
FIG. 9 is a side perspective view of the gear pump shown in FIG. 1 but having a different type of bracket, and the gear pump is connected to a cordless drill.
Figure 10:
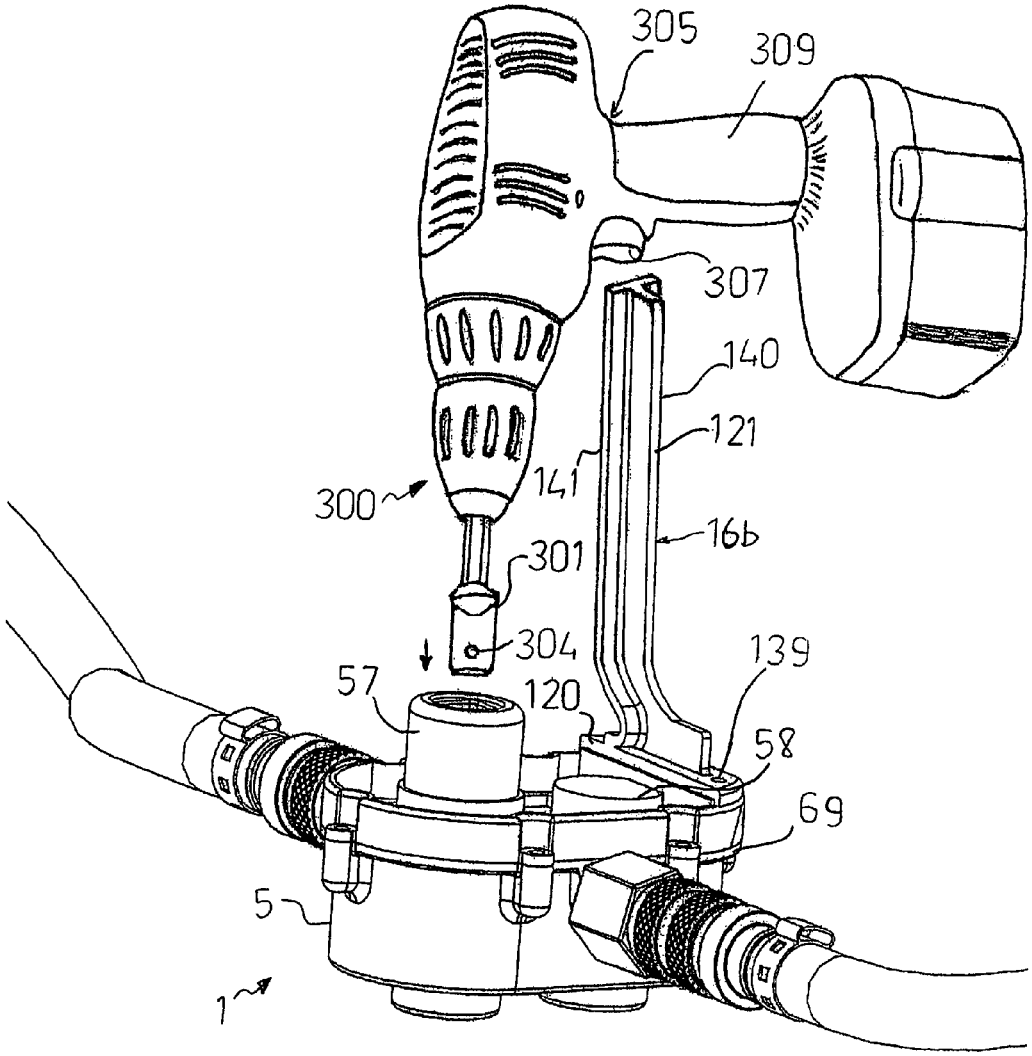
FIG. 10 is a side perspective view of the gear pump shown in FIG. 1 but having a different type of bracket, and the gear pump is being connected to a cordless drill.

As seen in FIGS. 9 and 10, the gear pump 1 may be used with a cordless drill 300 having a body 305 having a handle 309, an on/off trigger 307, a rotatable output shaft having a square-drive adaptor 301, and a switch (not shown) for setting the direction of rotation of the shaft 301. The bracket 16*a*, 16*b* extends from the housing 5. The bracket 16*a*, 16*b* has a base portion 120 and an upstanding portion 121. The upstanding portion 121 has an inner face 140, an outer face 141, and bracket 16*a* further has an upper end 142 that hooks partway around the handle 309. The base portion 120 extends between the pair of rails 22 of the top wall 61. One end of the base portion 120 hooks around and beneath rim 69 of the housing 5. The other end of the base portion 120 is fastened to the top wall 61 with a screw 139.

In use, the square-drive adaptor of the rotatable shaft 301 of the drill 300 is brought into engagement with the tool-engaging end piece 25 such that the hemi-spherical projections 304 lock within the openings 86. The switch for setting the direction of rotation of the shaft 301 is set such that fluid will be pumped from the inlet 65 to the outlet 66. Upon depressing the on/off trigger 307, the body 305 initially rotates into engagement with the inner face 140. For bracket 16*a*, the body 305 also initially rotates into engagement with the hooked end 142 of the upstanding portion 121 of the bracket 16*a* such that the pump 1 can be operated using a single hand without fear of disengagement of the pump 1 from the drill 300.

In order to pump fluid from the outlet 66 to the inlet 65, the rotation direction switch is set accordingly, the on/off trigger 307 is depressed and the body 305 rotates into engagement with the outer face 141 of the upstanding portion 121.

As seen in FIG. 11, the gear pump 1 may be used with a crank handle 400 having an end handle 409 and a rotatable output shaft 401. A bracket is not connected to the top wall 61. In use, the rotatable shaft 401 of the crank handle 400 is brought into engagement with the tool-engaging end piece 25 such that the hemi-spherical projections 404 lock within the openings 86. The crank handle 400 is then rotated in the desired direction such that fluid is pumped from the inlet 65 to outlet 66, or vice-versa.

Whilst the above has been given by way of illustrative example of the invention, many modifications and variations may be made thereto by persons skilled in the art without departing from the broad scope and ambit of the invention as herein set forth.

The term "comprise" and variants of the term such as "comprises" or "comprising" are used herein to denote the inclusion of a stated integer or stated integers but not to exclude any other integer or any other integers, unless in the context or usage an exclusive interpretation of the term is required.

I claim:

1. A gear pump for use with a hand-operated tool having a rotatable shaft, said gear pump comprising:

a housing having a chamber, an inlet for fluid into the chamber and an outlet for fluid from the chamber, wherein the housing comprises a top wall, a bottom wall, and at least one side wall extending around the chamber between the top and bottom walls; and a gear assembly comprising at least one gear mounted for rotation within the chamber between the inlet and outlet, and a drive shaft extending from the gear and externally of the chamber, wherein the drive shaft extends from a central axis of the gear, from each face of the gear, and the gear rotates about this axis, wherein:

the housing comprises a bottom bearing extending downwardly from the bottom wall of the housing and a top bearing extending upwardly from the top wall of the housing, such that opposing ends of the drive shaft locate and rotate within said bearings;

the top bearing is open-ended and the drive shaft extends sealingly there through;

there is a clearance between the top bearing and the tool-engaging end of the drive shaft, so as to accommodate any eccentricity in the rotation of the rotatable shaft of the tool;

the top bearing comprises a stepped diameter that provides a shoulder, an annular seal of the housing extends around the drive shaft and is sandwiched between an upper face of the at least one gear and the shoulder of the top bearing; and a tool-engaging end of the drive shaft is engageable with the rotatable shaft of the hand tool such that rotation of the drive shaft by the hand tool causes fluid to move between said inlet and outlet.

2. The gear pump of claim 1, wherein the tool-engaging end comprises a socket for receiving an end of the rotatable shaft of the tool.

3. The gear pump of claim 2, wherein the tool-engaging end and rotatable shaft have respective female and male portions that engage one another together such that they may not disengage by accident during operation.

4. The gear pump of claim 3, wherein the rotatable shaft has detents locatable within openings in the socket.

5. The gear pump of claim 1, wherein the drive shaft comprises a tool-engaging end piece having said tool-engaging end detachably connected to a remainder of the drive shaft, wherein the remainder of the drive shaft has a socket for receiving a lower end of the tool-engaging end piece.

6. The gear pump of claim 1, wherein the inlet and outlet are provided by respective inlet and outlet tubes extending from the housing side wall.

7. The gear pump of claim 6, wherein the gear pump comprises a shut-off valve associated with the inlet and a shut-off valve associated with the outlet.

8. The gear pump of claim 7, wherein the gear pump comprises a first hose fitting having the internal shut-off valve, and having a threaded end connectable to the inlet tube and an opposing end connectable to an inlet hose of the gear pump, and a second hose fitting having the internal shut-off valve, and having a threaded end connectable to the outlet tube and an opposing end connectable to an outlet hose of the gear pump.

9. The gear pump of claim 1, wherein the gear pump further comprises a holding member extending from the housing for engaging a body of the tool after the output shaft has engaged the drive shaft so as to stop the body from rotating through a complete revolution relative to the housing.

10. The gear pump of claim 9, wherein the holding member hooks around a top of the body of the tool.

11. The gear pump of claim 9 wherein the holding member is a bracket extending from a top wall of the housing.

12. The gear pump of claim 11, wherein the bracket is arcuate and hooks around a top of the body.

13. The gear pump of claim 12, wherein the bracket has various radii so as to facilitate proper engagement with tool bodies of varying diameter.

14. The gear pump of claim 1, wherein the gear assembly comprises a second idler gear having teeth intermeshed with the teeth of the at least one gear, and the chamber is substantially oval when viewed in plan.

* * * * *